US008740628B2

(12) United States Patent
Brooks et al.

(10) Patent No.: US 8,740,628 B2
(45) Date of Patent: Jun. 3, 2014

(54) LAMP PLUGS PROVIDING ENHANCED FUNCTIONALITY

(75) Inventors: Timothy W. Brooks, Madison, IN (US); Charles D. Polley, Madison, IN (US); Darren L. Harmon, Madison, IN (US); Eric Thorstensen, Madison, IN (US)

(73) Assignee: Grote Industries, Inc., Madison, IN (US)

( * ) Notice: Subject to any disclaimer, the term of this patent is extended or adjusted under 35 U.S.C. 154(b) by 38 days.

(21) Appl. No.: 13/331,146

(22) Filed: Dec. 20, 2011

(65) Prior Publication Data

US 2012/0156897 A1 Jun. 21, 2012

Related U.S. Application Data

(60) Provisional application No. 61/424,948, filed on Dec. 20, 2010.

(51) Int. Cl.
*H01R 31/06* (2006.01)

(52) U.S. Cl.
USPC ..... 439/35; 439/620.02

(58) Field of Classification Search
USPC ..... 439/35, 36, 502, 503, 505, 419, 614, 439/620.02
See application file for complete search history.

(56) References Cited

U.S. PATENT DOCUMENTS

| | | | | | |
|---|---|---|---|---|---|
| 2,660,679 | A | * | 11/1953 | Hunt | 307/10.1 |
| 4,057,310 | A | * | 11/1977 | Young | 439/35 |
| 4,241,371 | A | | 12/1980 | Sage | |
| 5,030,938 | A | | 7/1991 | Bondzeit | |
| 5,184,960 | A | * | 2/1993 | Hopkins et al. | 439/35 |
| 5,521,466 | A | | 5/1996 | Vincent | |
| 5,639,246 | A | * | 6/1997 | Holmes | 439/35 |
| 7,118,379 | B1 | * | 10/2006 | Wang | 439/35 |
| 7,575,438 | B2 | * | 8/2009 | Dilgard | 439/35 |
| 7,893,622 | B2 | | 2/2011 | Chang | |
| 7,955,085 | B2 | * | 6/2011 | Rotenberg et al. | 439/35 |
| 2010/0308984 | A1 | | 12/2010 | Ehrlich | |
| 2011/0237090 | A1 | | 9/2011 | Ehrlich | |

OTHER PUBLICATIONS

Lawrence, Mark; Motorcycle Lights [online], Feb. 25, 2004; Retrieved From Internet Archive, http://web.archive.org/web/20040225084649/http://motorcycleinfo.calsci.com/Lights/html.

Radiant, Inc.; Dual Element Circuit for Flex 5-10 LEDs [online], Dec. 15, 2005; Retrieved From Internet Archive http://web.archive.org/web/20051211211811/http://www.radiantz.com/index.html?626.html&1.

Thorstensen,Eric; Auxilliary High Mount Stop and Turn Lights; May 1, 2008; Alamo City, Nevada.

Canadian Application No. 2762700 Office Action issued on Dec. 30, 2013.

* cited by examiner

*Primary Examiner* — Thanh Tam Le
(74) *Attorney, Agent, or Firm* — Woodard, Emhardt, Moriarty, McNett & Henry LLP

(57) ABSTRACT

Lamp plugs are disclosed, in which single intensity marker lamps that are desired to be flashed can be connected to a lamp driver employing an exclusive OR (XOR) logic circuit. In one embodiment, the lamp plug is an overmolded subsystem that is installed between the lamp and the lamp driver and allows the installer to use existing wire harnesses. In some embodiments, the overmolded subsystem is installed under a standard lamp where a plug is typically plugged in; therefore staying on the vehicle and not needing to be replaced with the lamp. Other embodiments are disclosed.

12 Claims, 10 Drawing Sheets

LAMP PLUGS PROVIDING ENHANCED FUNCTIONALITY

CROSS-REFERENCE TO RELATED APPLICATIONS

This application claims the benefit of U.S. Provisional Application No. 61/424,948 filed Dec. 20, 2010, which is hereby incorporated by reference.

TECHNICAL FIELD OF THE DISCLOSURE

The present disclosure generally relates to lamps and, more particularly, to a lamp plug providing enhanced functionality to the lamp.

BACKGROUND OF THE DISCLOSURE

Although the presently disclosed embodiments will find application in a wide variety of lamp applications, it is instructive to review the trailer marker lamp application. Trailer manufacturers have designed rows of marker lamps located on trailers, such as commercial semi trailers to name just one non-limiting example, for appearance. In some cases, trailer manufacturers wish to flash one or more of these marker lamps when the vehicle operator activates the turn or hazard function flashes. To enable this, dual intensity marker lamps have been developed. The low intensity (or minor) function meets the marker lamp photometric requirements, and the high intensity (or major) function is brighter. Alternating activation of the low and high intensity functions causes the marker lamp to exhibit a flashing appearance.

These dual intensity marker lamps are more expensive to manufacture, require a second part number for the customer (i.e. a part number that is different than that used for the single intensity marker lamp), and have three terminals or wires in the lamp (minor, major and ground). Typically, the design goal for such dual intensity marker lamps is as much intensity difference between the minor and major function as possible, which results in a lower intensity minor function—or a dimmer marker than a standard single intensity marker lamp. Some trailer designers have placed an entire row of marker lamps along the side of a trailer. Using a dual intensity marker lamp in such a row of single intensity marker lamps results in one lamp that does not exactly match the others in intensity, even when all are being operated with the lower intensity minor function. This results in a non-uniform, undesirable appearance.

Trailer manufacturers and designers would prefer a flashing solution that uses standard single intensity marker lamps. These single intensity marker lamps have two terminals or wires in the lamp, namely power and ground.

Additionally, it is desirable that any solution to this problem also minimize or eliminate changes necessary to the vehicle wiring harness.

SUMMARY OF THE DISCLOSURE

In some of the presently disclosed embodiments, a plug, into which a standard lamp may be inserted, contains electronics integrally molded therein in order to provide enhanced functionality to the standard lamp without requiring electronics to be incorporated into the wiring harness.

In some embodiments, an adapter for a lamp on a vehicle includes a housing containing a logic circuit operative to implement an exclusive OR (XOR) logic function, at least one wiring harness connector coupled to the logic circuit and configured to connect the logic circuit to a wiring harness of a vehicle, and at least one lamp connector coupled to the logic circuit and configured to connect the logic circuit to a lamp.

In some embodiments, an adapter for a lamp on a vehicle includes a housing containing a circuit configured to connect a two-wire lamp to a three-wire wiring harness and the housing is configured for positioning between a lamp assembly and a surface of a vehicle.

In other embodiments, an adapter for lamps on motor vehicles includes a harness that connects a standard lamp to a wiring harness of a vehicle and contains an overmolded circuit, wherein the circuit modifies an incoming signal from the wiring harness of the vehicle to add more functions to the standard lamp.

In some embodiments, a circuit is overmolded in an adapter that fits under a standard lamp, wherein the adapter is designed to fit the standard terminals of the lamp and an existing wiring harness, and wherein the circuit modifies the incoming signal from the wiring harness to add more functions to the standard lamp.

By using the presently disclosed lamp plug embodiments, trailer manufacturers can use standard marker lamps in auxiliary lamp locations and incorporate enhanced functionality into the lamps, lowering their overall costs. Other embodiments are also disclosed.

DETAILED DESCRIPTION OF THE VARIOUS EMBODIMENTS

Figure 1:
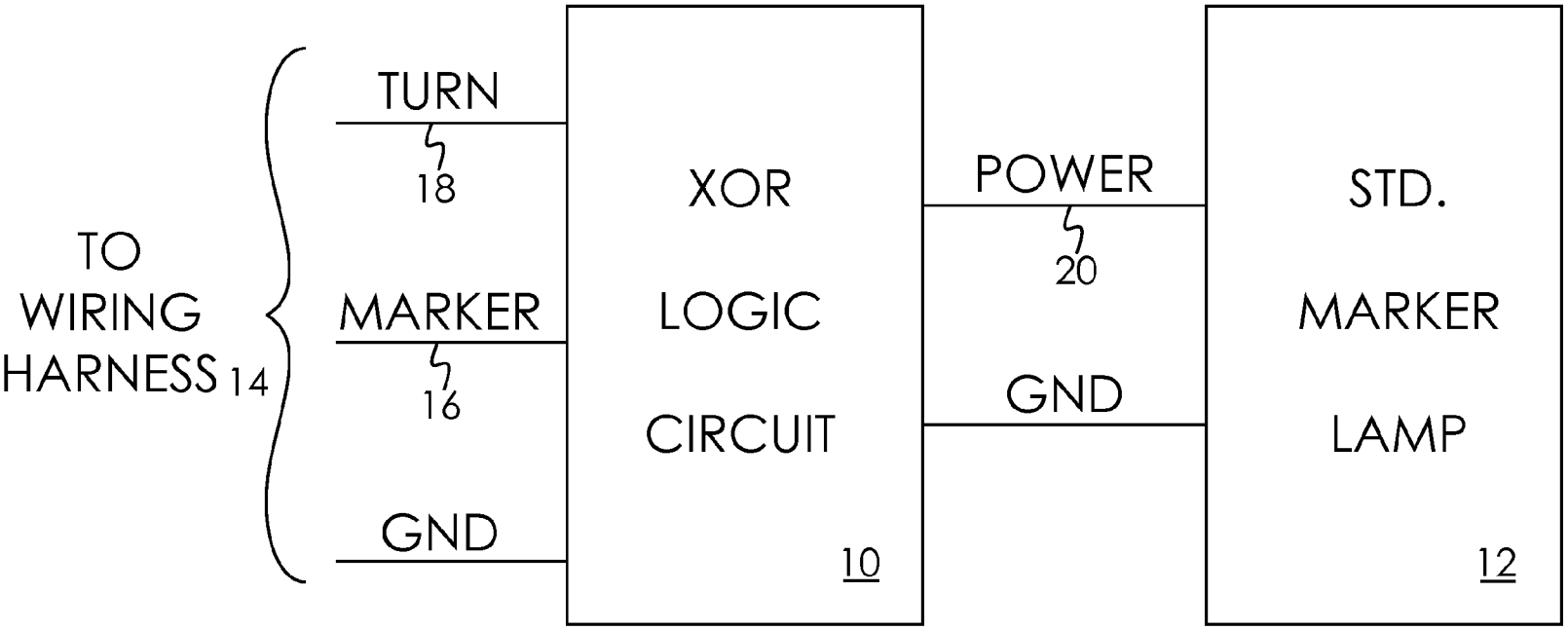
FIG. 1 is a schematic block diagram illustrating one embodiment of the present disclosure.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Exclusive OR (XOR) Logic for Marker Lamp Control

An exclusive OR (XOR) logic circuit provides a voltage to its output if any one of the inputs receives a voltage. If the inputs to the XOR circuit are all high or all low, there is no output. In one embodiment, single intensity marker lamps that the trailer designer wishes to flash can be connected to a lamp driver employing an exclusive OR (XOR) circuit as disclosed herein. Using this driver, all of the marker lamps in a row can be of the same style, but one lamp can be flashed in the row of marker lamps. In some embodiments, if all of the marker lamps are on, the lamp being driven by the XOR driver circuit will flash out of sequence with the turn signal flash. If all of the marker lamps are off, the lamp being driven by the XOR driver circuit will flash in sequence with the turn signal flash.

If an XOR logic circuit 10 is placed between a standard single intensity marker lamp 12 and the vehicular wiring harness 14 that drives the marker lamp 12, as shown in FIG. 1, such that the marker function wire 16 of the vehicular wiring harness 14 and the turn function wire 18 of the vehicular wiring harness 14 are both applied as inputs to the XOR logic circuit 10, the standard marker lamp 12 can be connected to the output 20 of the XOR logic circuit 10 and operate per the truth table shown in Table 1 below.

TABLE 1

XOR Logic Circuit Truth Table

| Turn Function | Marker Function | Lamp Operation |
|---|---|---|
| 0 (no voltage) | 0 (no voltage) | Off (no light) |
| 0 (no voltage) | 1 (voltage) | On (light) |
| 1 (voltage) | 0 (no voltage) | On (light) |
| 1 (voltage) | 1 (voltage) | Off (no light) |

When neither the marker function wire 16 nor turn function wire 18 is active (i.e., no operating voltage is present on either wire) the lamp 12 is off. When both the marker function wire 16 and turn function wire 18 are active (i.e., an operating voltage is present on both wires), the lamp 12 is off. If either (but not both) of the marker function wire 16 or turn function wire 18 are active (i.e., an operating voltage is present on one but not both of the wires), the lamp 12 is on.

To describe the operation another way, if the marker function wire 16 is off, the lamp 12 will flash in sequence with the other lamps flashing on the trailer. If the marker function wire 16 is on, the lamp 12 will flash out of sequence with the other lamps flashing on the trailer.

The XOR logic circuit 10 may be located in any convenient location, inside a lamp or outside the lamp.

Figure 2:
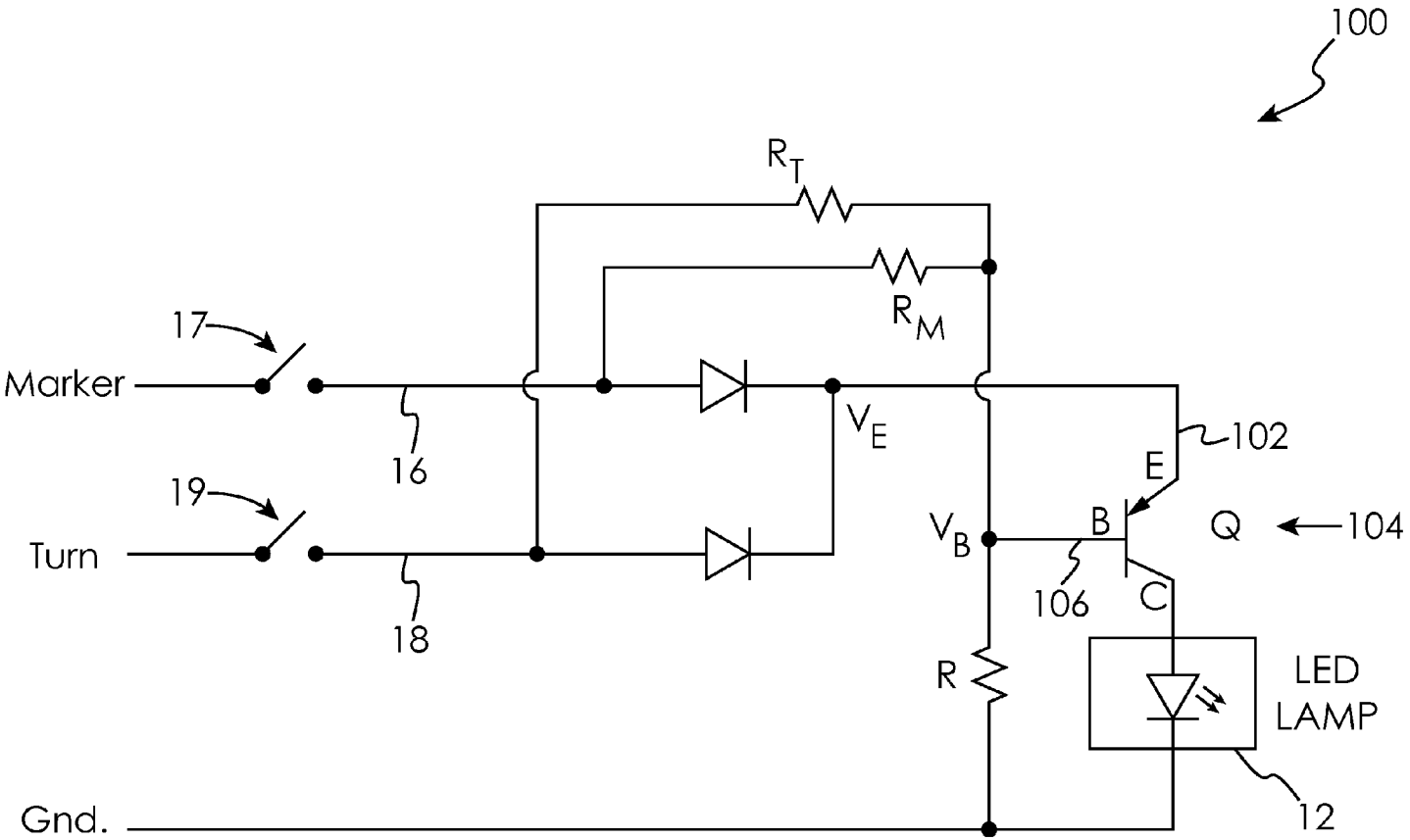
FIG. 2 is a schematic electrical circuit diagram illustrating one embodiment of the present disclosure.

FIG. 2 illustrates a schematic electrical circuit diagram of an XOR logic circuit 100 of one embodiment of the present disclosure. The circuit in FIG. 2 operates as follows. When both marker function wire 16 and turn function wire 18 are open (i.e. switches 17 and 19 are open and no operating voltage is present), there is no voltage to the circuit 100. No voltage is available to power the lamp 12 and it is off. If either switch 17 or 19 is closed, there is a voltage present at the emitter 102 of the transistor 104. There is also a voltage at the base 106 of the transistor 104 that is equivalent to the voltage divider RT or RM, and R. If the transistor 104 is a PNP bipolar transistor, the resistances must be selected so that the voltage at the base 106 of the transistor 104 is more than 0.6V lower than the voltage at the emitter 102, thus assuring that the transistor 104 is turned on, current flows through the lamp 12 and it is turned on. With this design, if either of the marker function wire 16 or turn function wire 18 supplies an appropriate level of voltage, the lamp 12 will turn on. If both the marker function wire 16 and turn function wire 18 are on (i.e., supply an appropriate level of voltage), there is still voltage to the emitter 102 of the transistor 104. However, now the voltage at the base 106 is set by the voltage divider from the parallel connection of RT and RM and R. If the resistors RT and RM are selected correctly, the base 106 of the transistor 104 will be less than 0.6V than the emitter 102 and the transistor 104 will not be turned on. With this design, if both the marker function wire 16 and turn function wire 18 supply an appropriate level of voltage, the transistor 104 will be off and the lamp 12 will not light.

Note that transistor 104 can be any type of switching device that has a switching control input that is operative to selectively conductively couple a power input terminal to an output terminal, such as a metal oxide semiconductor field effect transistor (MOSFET), or other type of transistor or switching device, and the resistances selected so that the switching control input voltage will turn on and off at the proper inputs.

Figure 3:
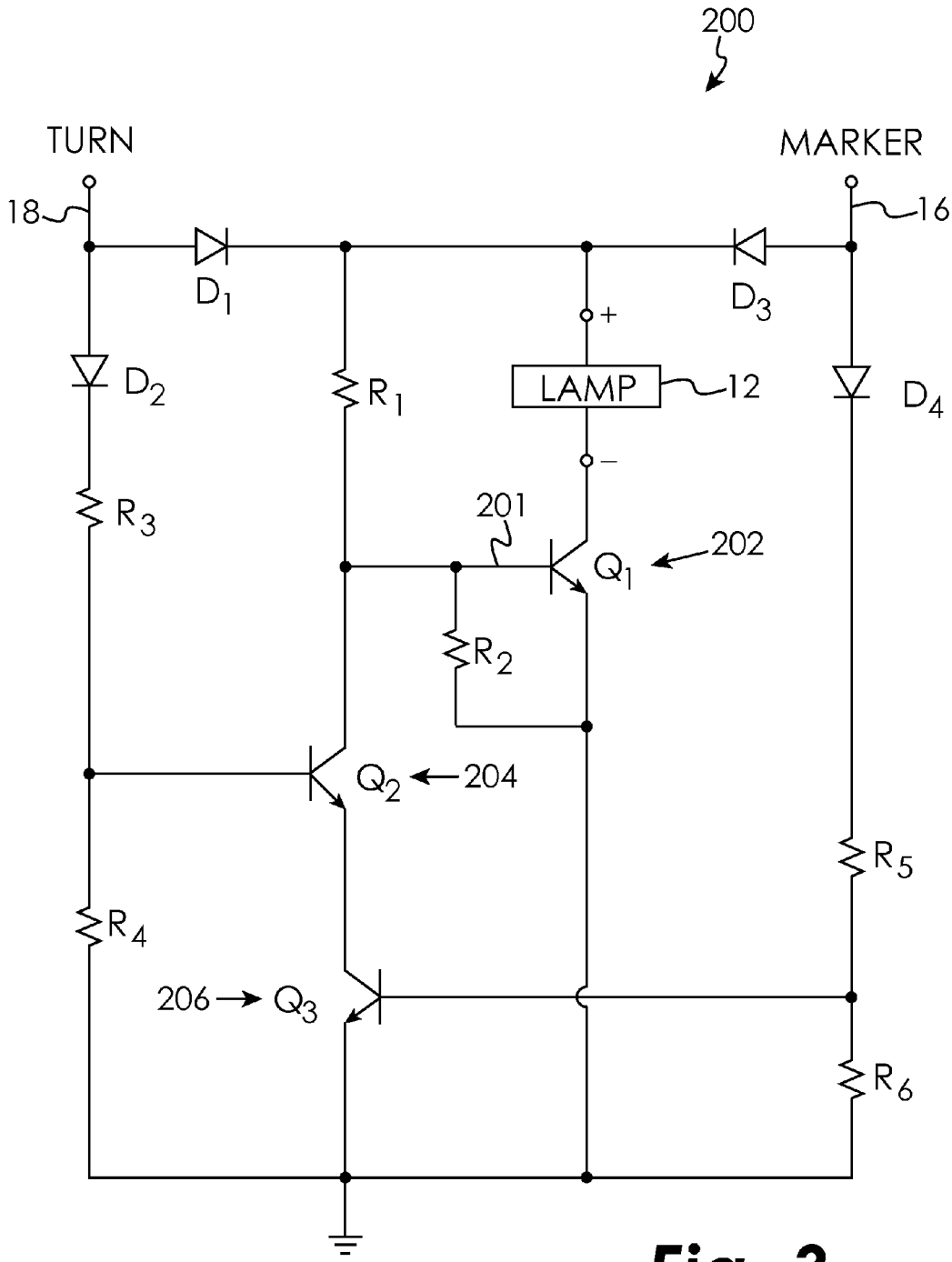
FIG. 3 is a schematic electrical circuit diagram illustrating one embodiment of the present disclosure.

FIG. 3 illustrates a schematic electrical circuit diagram of an XOR logic circuit 200 of another embodiment of the present disclosure. FIG. 3 operates as follows. If neither marker function wire 16 nor turn function wire 18 are on, there is no power to the circuit and the lamp 12 is off. If there is voltage applied to either or both the marker function wire 16 or turn function wire 18, there is power applied to the lamp 12 and to the base 201 of transistor 202 via one or both rectifier diodes D1 and/or D3. There are two transistors, 204 and 206, connected in series to the base 201 of transistor 202. If there is power applied to only one input 16 or 18, only one of the transistors 204 and 206 are on, the other transistor is off and transistor 202 remains on (since its base 201 is not grounded through the transistors 204 and 206, one of which is off). When transistor 202 remains on and there is power to the lamp 12, the lamp 12 will be illuminated. If power is applied to both inputs 16 and 18, both of the transistors 204 and 206 will be on. Since transistors 204 and 206 are connected in series to ground, when both transistors 204 and 206 are on, the voltage at the base 201 of transistor 202 will be less than 0.6V and transistor 202 is off. If transistor 202 is off, no current can flow through the lamp 12 and the lamp 12 will be turned off. It will be appreciated by those skilled in the art that in the embodiments of both FIGS. 2 and 3, the lamp 12 may be placed on either side of the controlling switching device 104, 202 (i.e., high side control or low side control). It shall be further understood that resistor R2 as shown in FIG. 3 may be optionally omitted, depending on the needs of the particular application.

TABLE 2

XOR Logic Circuit Truth Table for FIG. 3

| Turn Function 18 | Marker Function 16 | Q1 | Q2 | Q3 | Lamp Operation |
|---|---|---|---|---|---|
| 0 (no voltage) | 0 (no voltage) | Off | Off | Off | Off (no light) |
| 0 (no voltage) | 1 (voltage) | On | Off | On | On (light) |
| 1 (voltage) | 0 (no voltage) | On | On | Off | On (light) |
| 1 (voltage) | 1 (voltage) | Off | On | On | Off (no light) |

By using the presently disclosed lamp driver embodiments, trailer manufacturers can use standard single intensity marker lamps in auxiliary lamp locations and combine the flash and marker functions in one lamp, increasing conspicuity and lowering their overall costs.

Lamp Plugs with Enhanced Functionality

Trailer manufacturers have designed standard marker lamps on trailers for appearance. Standard marker lamps have two terminals or wires in the lamp, namely power and ground. The lamps that the trailer designer wishes to use are typically standard lamps, since these lamps are manufactured and purchased in bulk to minimize cost. Many times, the lamp is miniaturized to reduce cost of the lamp, the cost of the installation, and the footprint of the lamp on the trailer. For these and other reasons, trailer manufacturers would like to use standard marker lamps in auxiliary lamp locations. Using standard lamps will also allow the trailer manufacturer to reduce part number SKU's in their plant, lowering their overall costs.

Figure 4:
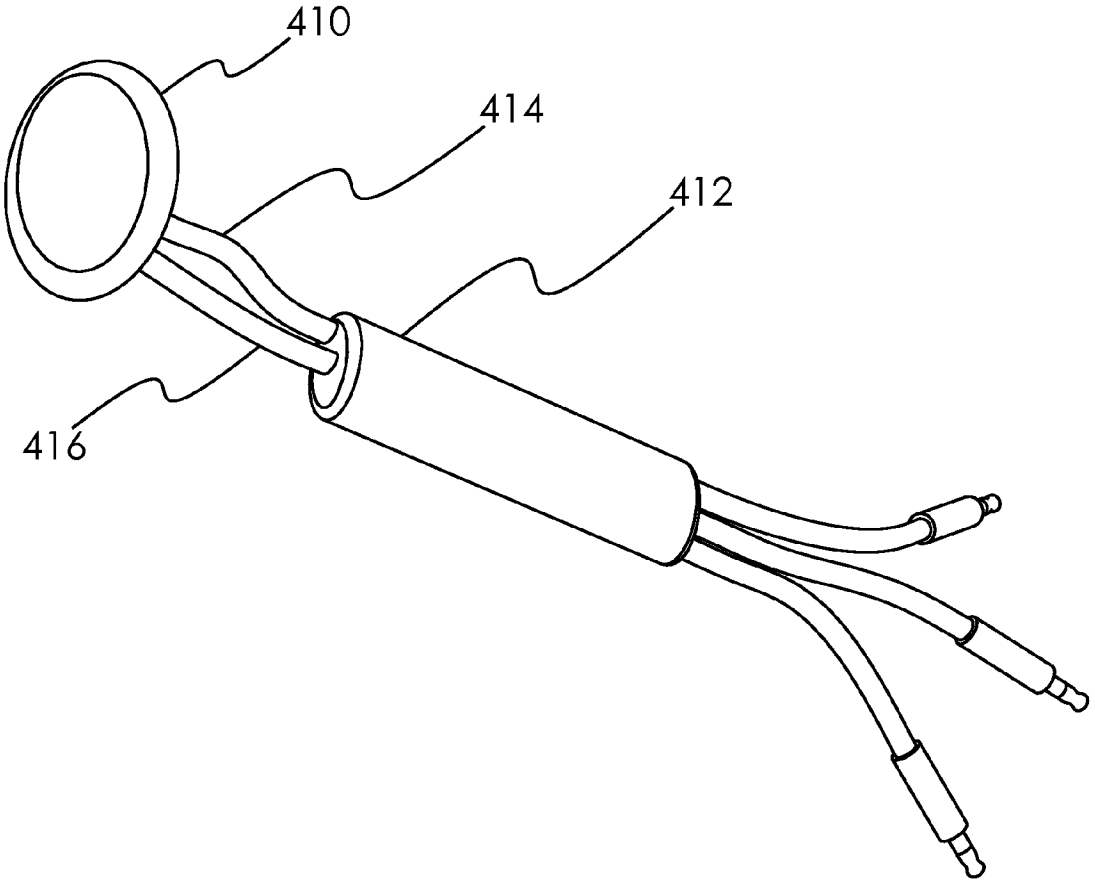
Fig. 4 (Prior Art)
FIG. 4 is a perspective view of a prior art lamp with externally overmolded circuitry.

The first light emitting diode (LED) lamps were roughly the same size as incandescent bulb based lamps, since bulbs were the predominant technology at the time. As LED lamps were introduced into vehicle lighting, electronics were integrated onto the lamp to provide the proper power to the LED's. Since the first lamps were large, there was adequate room for the ancillary electronic components. As the market accepted LED lamps as a preferred technology over incandescent bulbs, the size of the lamps shrank. The size of the lamp shrank to the point that not all of the needed electrical components could fit inside the lamp body. As shown in FIG. 4, companies began to move the components off of the lamp 410 and into an overmolded assembly 412. This overmolded assembly 412 is separate from the lamp 410, but connected to the lamp 410 through wires 414 and 416. Unfortunately, this lamp and electronics assembly adds cost and creates a unique lamp and a unique lamp part number.

The presently disclosed embodiments use standard lamps that allow a separation of the electronics from the lamp.

Figure 5:
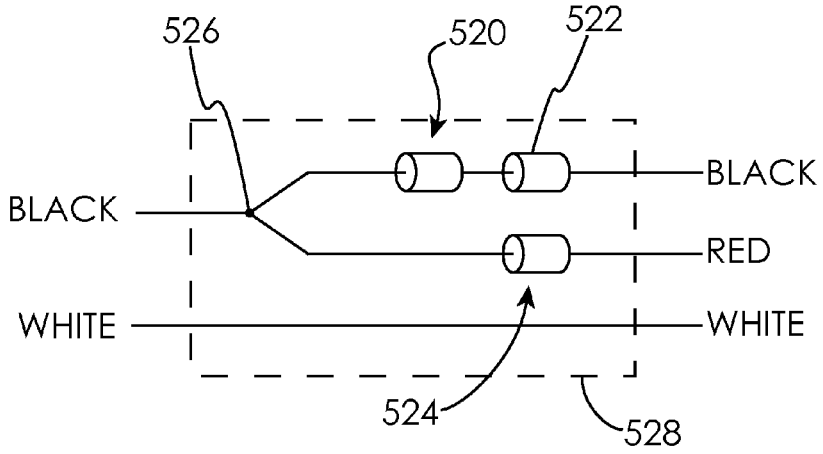
FIG. 5 is a schematic electrical circuit diagram illustrating one embodiment of the present disclosure.
Figure 6:
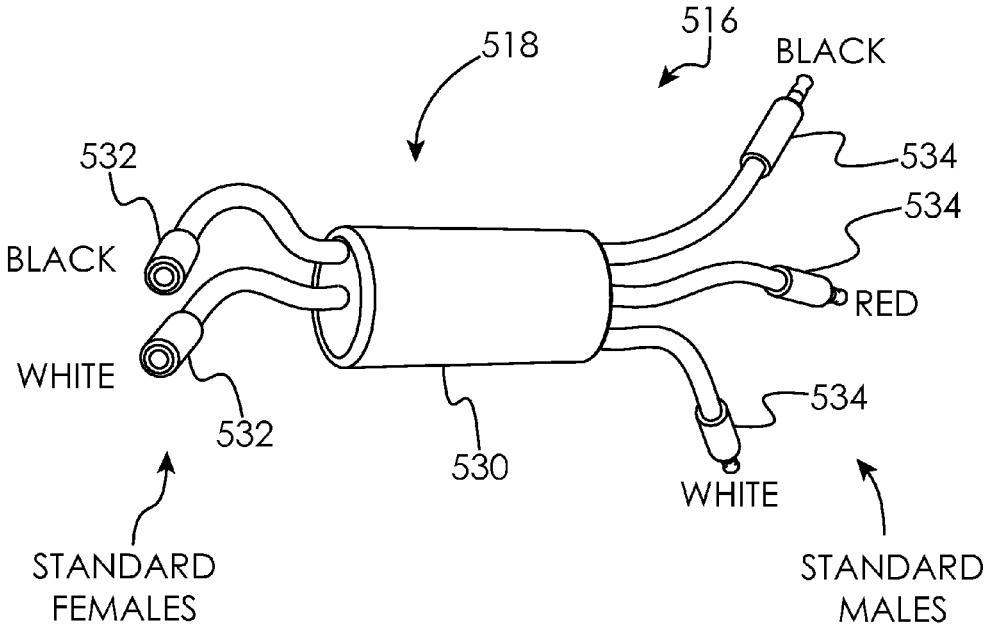
FIG. 6 is a perspective view illustrating one embodiment of the present disclosure.

In a first embodiment, a harness or adapter 516 comprises an overmolded subsystem 518. This adapter 516 adds a function to a standard, two-wire lamp (such as the XOR function described hereinabove), when connected to a standard trailer wiring harness system that provides three wires to lamps, as illustrated in FIGS. 5-6. In the illustrated embodiment, the overmolded electronics include a resistor 520 and two diodes 522 and 524. Adding a resistor to one line will reduce the current supplied to the lamp, providing a second intensity to the lamp. A single intensity lamp can thus be driven as a dual intensity lamp. Those skilled in the art will recognize that any configuration of electrical components may be substituted for those shown in the illustrated embodiment of FIG. 5. Junction 526 may comprise any type of suitable attachment, such as a sonic weld or a solder joint, to name just two non-limiting examples. The portion within the dashed lines 528 may be overmolded using an appropriate mold and overmolding material, as is known in the art, to create the overmolded area 530.

Adapter 516 includes at least one lamp connector 532 that is coupled to the overmolded electronics and is configured to connect the overmolded electronics to a lamp. Adapter 516 also includes at least one wiring harness connector 534 that is coupled to the overmolded electronics and is configured to connect the overmolded electronics to the wiring harness on the trailer. As one of ordinary skill in the art can appreciate, connectors 532 and 534 may comprise one or more electrical contacts for connecting one or more electrical paths between the overmolded electronics and the lamp and/or wiring harness. Additionally, the connectors may be in a variety of shapes and configurations. FIG. 6 shows one type of electrical connector, but the disclosed embodiments may be used with any variety of connectors including those commonly used in the automotive and trailer industry.

Figure 7:
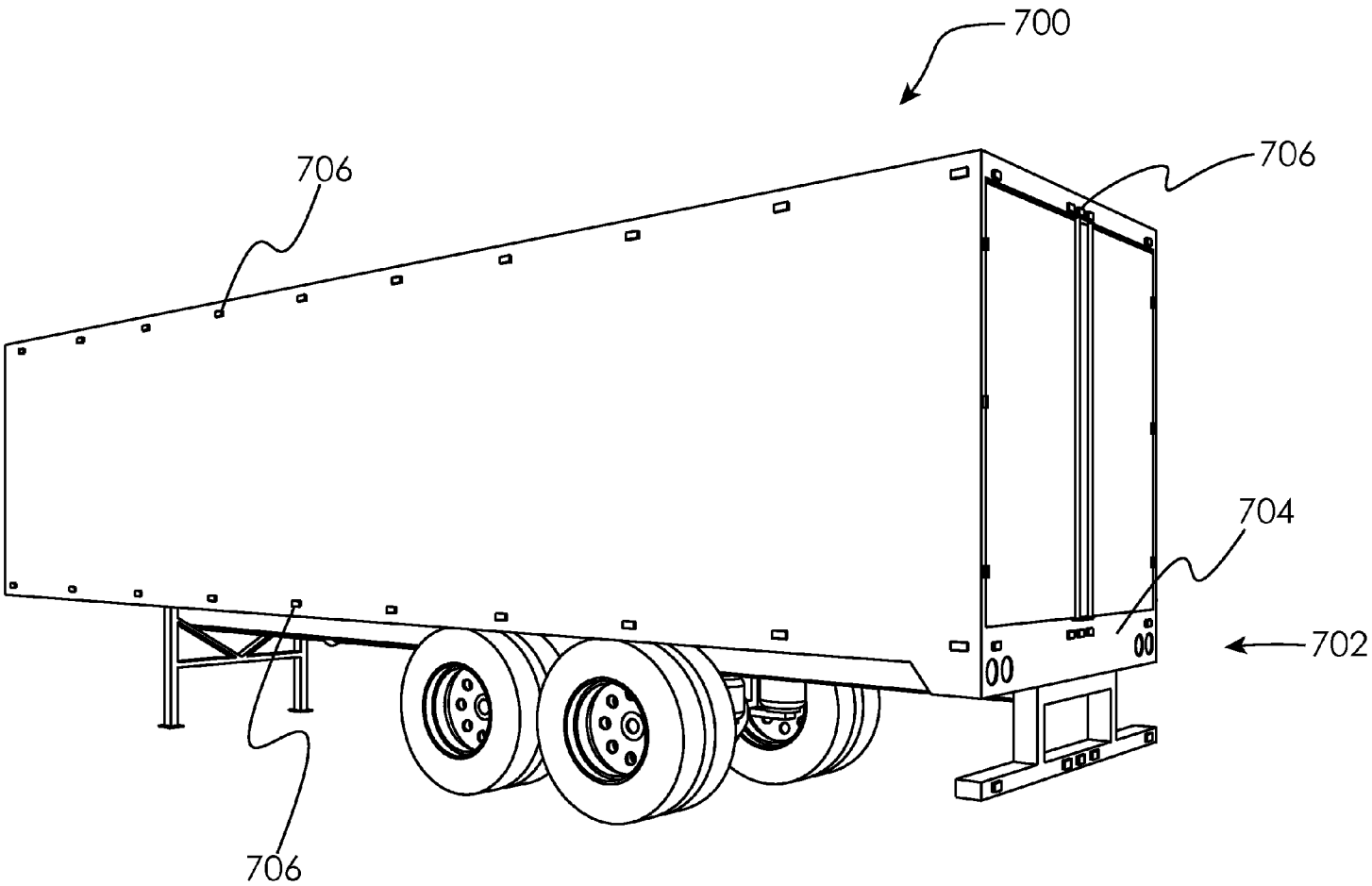
FIG. 7 is a perspective view illustrating one environment in which the present disclosure may be implemented.

The adapter 516 allows the installer to use standard, 2-wire lamps for two functions (turn/hazard indication and marker indication) as opposed to the existing single function and/or three-wire lamps. This adapter 516 may be used for lamps in a variety of locations on a variety of vehicles. For example, this adapter 516 may be designed to connect to a trailer rear sill system 702, located in the rear buck-plate 704 of the trailer 700, as illustrated in FIG. 7. Similarly, this adapter may be used to connect marker lamps 706 positioned at other locations on the trailer 700. Using this adapter, enhanced functionality may thus be added to a standard marker lamp 706 by connecting the lamp to the adapter 516.

In another embodiment, an adapter having an overmolded subsystem is installed under a standard lamp where a plug is typically plugged in. This allows a standard lamp to utilize added features without adding parts or significant mass to the wiring harness system. Since the standard lamp already mates with a plug to facilitate replacement of the lamp in the field, no additional assembly or tooling is required to add the enhanced functionality.

Figure 8:
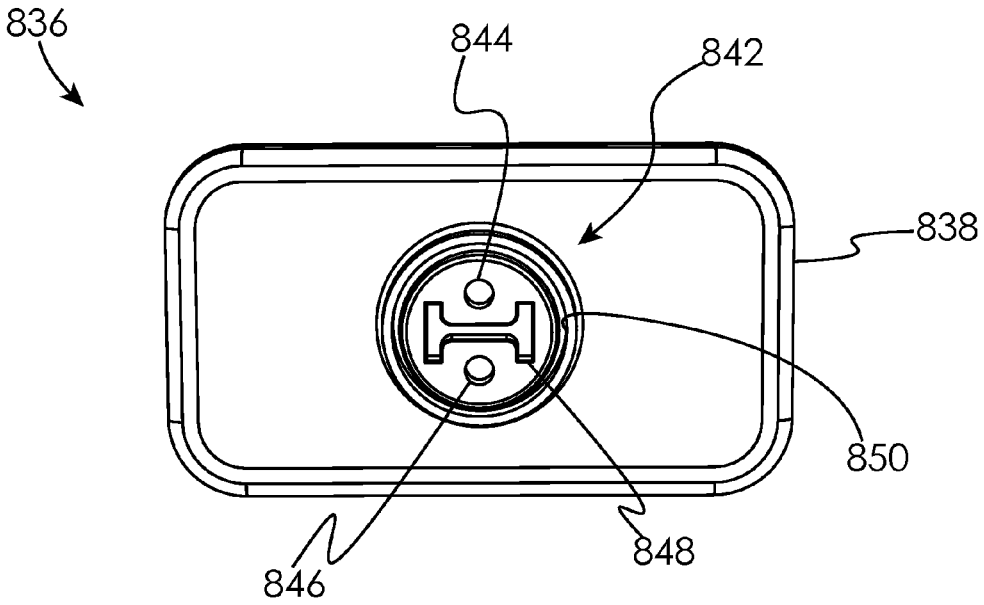
FIG. 8 is a plan view illustrating one embodiment of the present disclosure.
Figure 9:
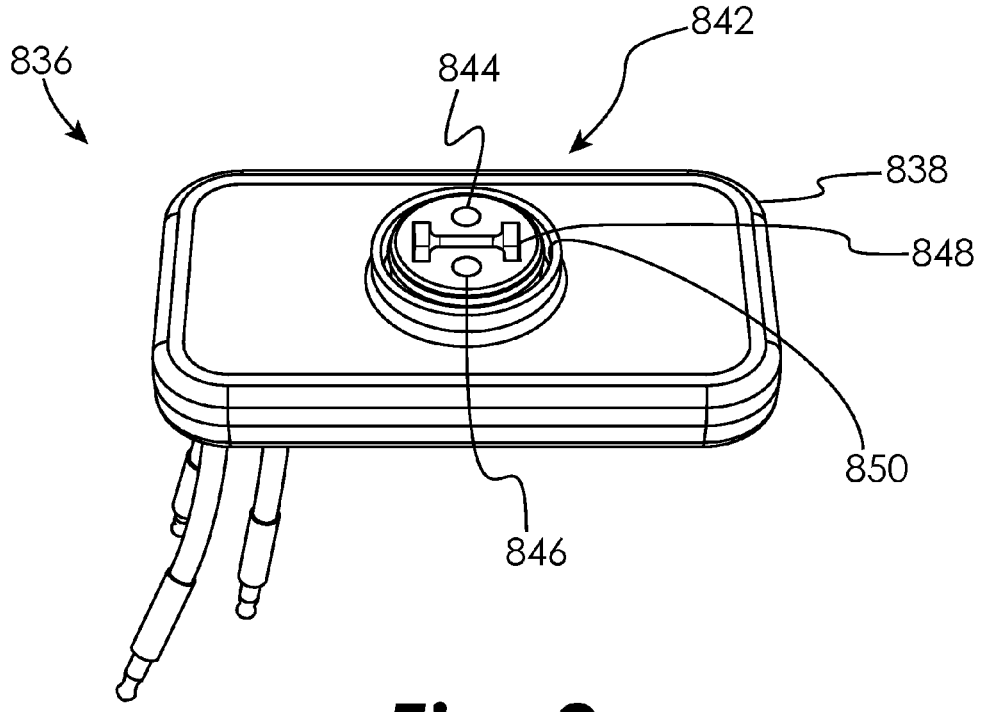
FIG. 9 is a front perspective view of the embodiment of FIG. 7.
Figure 10:
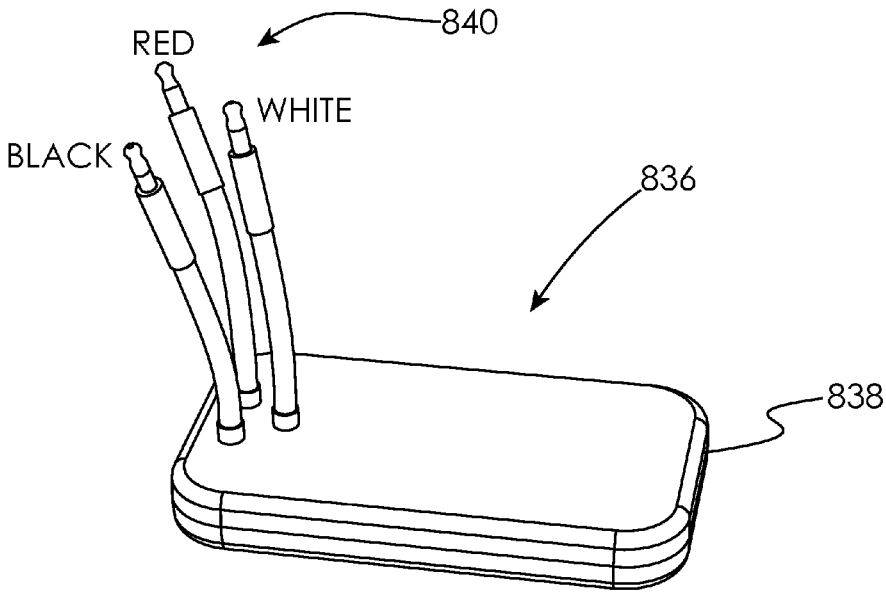
FIG. 10 is a rear perspective view of the embodiment of FIG. 7.

As shown in FIGS. 8-10, harness or adapter 836 comprises a housing 838, one or more wiring harness connectors 840, and a lamp connector and/or plug 842. The electronic circuitry and wiring desired to provide the enhanced functionality, such as the XOR function circuitry described hereinabove to name just one non-limiting example, is contained inside protective housing 838. As one of ordinary skill in the art can appreciate, housing 838 preferably protects the electronic circuitry and wiring from liquid intrusion and, to at least a minimal degree, from impact. The electronic circuitry and wiring may be inserted and sealed inside of a preassembled housing, or alternatively, the housing 838 may be formed around the electronic circuitry and wiring. For example, a plastic enclosure may be injection molded over the circuitry. Preferably, the electronic circuitry and wiring is overmolded inside housing 838 using an appropriate mold and overmolding material as is known in the art.

As can be seen in FIGS. 9 and 10, black, red and white wires with standard male connectors for connection to a standard wiring harness exit the rear of the housing 838. As mentioned above, these wires may be combined into one or more connectors. As illustrated, plug 842 is configured to couple to an oppositely sexed plug 852 on the rear of the standard lamp 854 (see FIGS. 11 and 12). As described hereinabove, provision of the plug coupling between the standard lamp and the adapter 836 facilitates replacement of the standard lamp in the field. Furthermore, placement of plug 842 on the surface of housing 838 of adapter 836 may further decrease the space requirements of the adapter 836. In some embodiments, plug 842 and wiring harness connectors 840 are positioned on different surfaces of the housing 838. Preferably, plug 842 and connectors 840 are on opposite sides of the housing 838. This arrangement may decrease the space requirements for adapter 836 and facilitate installation of the adapter 836 in the field.

In the illustrated embodiment of FIG. 7, the plug 842 includes two female terminals 844 and 846 corresponding to the standard black and white wire connections for the standard lamp. In this embodiment, one or more surfaces of a lamp connector are configured to conform to one or more surfaces of a lamp or lamp assembly. As shown in the figure, plug 842 includes alignment recesses 848 and 850 to facilitate proper alignment of the standard lamp with the female terminals 844 and 846, as well as to facilitate a tight and weather resistant seal. Those skilled in the art will recognize that the particular design of the plug 842 and the electrical circuitry contained within the adapter 836 are design choices and are not critical to the present invention.

Figure 11:
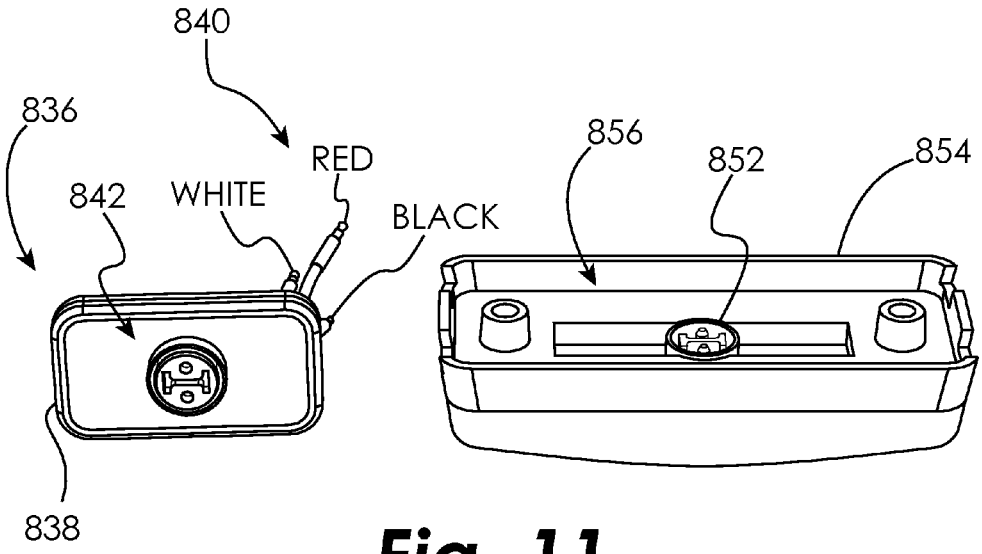
FIG. 11 is a perspective view of the embodiment of FIG. 7 and a standard marker lamp.
Figure 12:
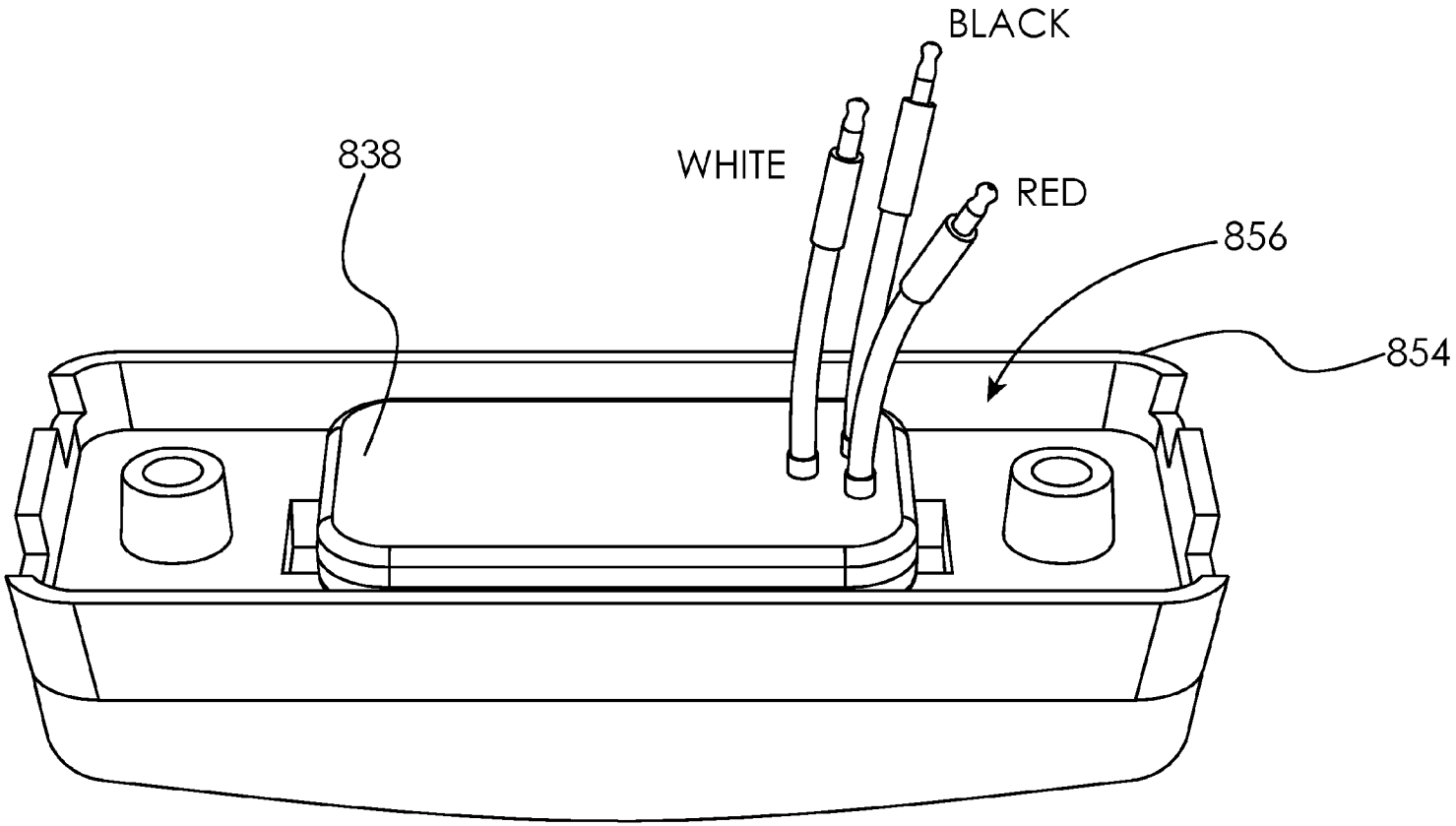
FIG. 12 is a rear perspective view of the embodiment of FIG. 7 mounted to a standard marker lamp.

FIGS. 11 and 12 illustrate the adapter 836 being mated with a standard lamp assembly 854 by interengaging plug 842 of adapter 836 with the plug 852 of the standard lamp assembly 854. When plug 842 and plug 852 are engaged, at least a portion of housing 838 of adapter 836 is inside of a recess 856 in the standard lamp assembly 854. Preferably, the entire adapter 836 and/or housing 838 has a low profile, with the exception of the wiring harness connectors 840, and therefore fits entirely within recess 856 so as to not interfere with mounting the standard lamp assembly 854 to the body of a trailer. In this arrangement, when standard lamp assembly 854 is attached to the body of a trailer, housing 838 of adapter 836 is encapsulated between the trailer and the standard lamp assembly 854. For lamp fixtures located on the rear buck-plate 704 of a trailer 700, housing 838 is confined between the standard lamp assembly 854 and a surface of the rear buck-plate 704. Adapter 836 and housing 838, however, may be the same size or slightly larger than the recess 856 in the standard lamp assembly 854 and still applied to the standard lamp assembly 854 and trailer 700 in this fashion.

To aid in the nested arrangement described above, one or more surfaces of housing 838 may also be configured to conform to one or more surfaces defining the recess 856 of the standard lamp assembly 854. Conforming a surface of the housing 838 to a surface of the standard lamp assembly 854 may aid in decreasing the size of the combined assembly; may limit the "play" between the adapter 836 and the standard lamp assembly 854, thereby reducing wear on plug 842 and terminals 844, and 846; and may accommodate room for additional electronics inside of the housing 838.

The combined assembly (adapter 836 and standard lamp assembly 854) will interface with the standard wiring harness with no changes needed to the wiring harness, yet the adapter 836 provides enhanced functionality to the standard lamp 854. The plug connection 842/852 allows the standard lamp 854 to be easily replaced in the field with another standard lamp 854. Therefore, the electronic circuitry that provides enhanced functionality to the standard lamp 854 stays on the vehicle and does not need to be replaced when the standard lamp 854 is replaced.

Figure 13:
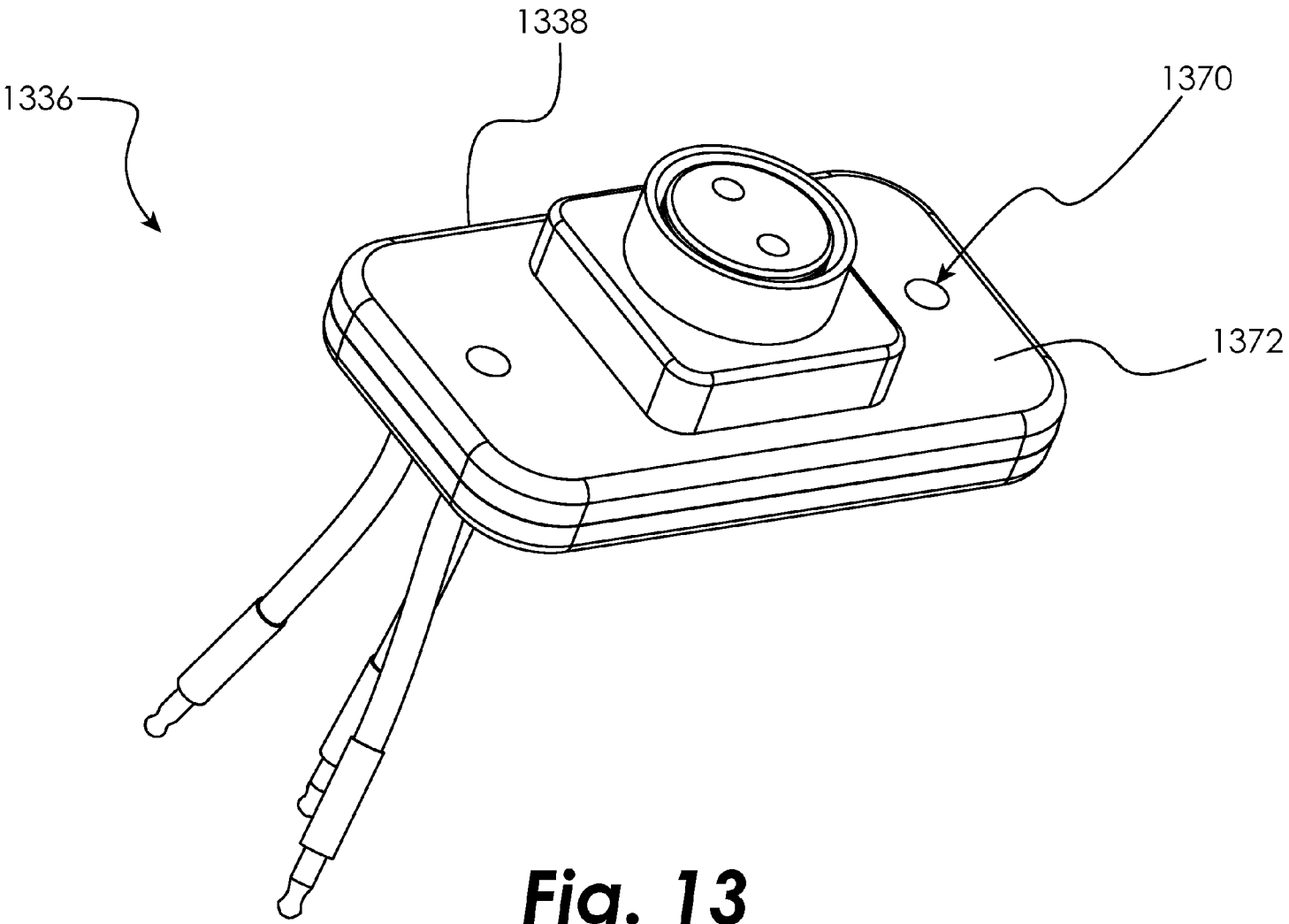
FIG. 13 is a perspective view illustrating one embodiment of the present disclosure.

Other embodiments from the above discussion will be clear to one of ordinary skill in the art. For example, as illustrated in FIG. 13, an adapter 1336 comprised of housing 1338 may have one or more holes 1370 in the housing 1338 to accommodate one or more fasteners (not shown) traveling from a lamp and/or lamp assembly to the body of the trailer. Certain embodiments may also have a surface 1372 for the standard lamp assembly 854 to be mounted to. In these embodiments, the adapter 1336 contains the electronics to add more functions to the standard lamp, as in the above embodiments, and serves as a spacer to displace lamp assembly 854 further away from the body of the trailer. This may aid in making the lights more visible to other motorists, particularly if the lights are located in a recessed portion of the trailer.

Other functions, as will be apparent to one of ordinary skill in the art from this disclosure, may be added to the above described adapters and various embodiments. For example, the circuit in the adapter may monitor an incoming signal and use that signal to determine the power to be applied to the lamp. Similarly, the circuit may monitor the operation of the lamp and, for example, provide notification to a driver and/or operator of a faulty lamp condition.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the disclosed embodiments relate to trailer lighting applications; however, one skilled in the art will recognize that the principles of the present invention will find application with any lighting system.

What is claimed is:

1. An adapter for a vehicle lamp, comprising:

a housing containing a logic circuit operative to implement an XOR logic function;

at least one wiring harness connector coupled to said logic circuit and configured to connect said logic circuit to a wiring harness of a vehicle; and at least one lamp connector coupled to said logic circuit and configured to connect the logic circuit to the vehicle lamp;

wherein said XOR logic circuit comprises:

a turn input;

a marker input; and a power output, said logic circuit operative to perform an XOR comparison of said turn and marker inputs to determine the state of said power output;

wherein said turn input and said marker input are connected to said wiring harness connector; and wherein said power output is connected to said lamp connector.

2. The adapter of claim 1, wherein:

the lamp connector is positioned on a surface of the housing.

3. The adapter of claim 2, wherein:

the lamp connector is positioned on a first surface of the housing and the wiring harness connector is positioned on a second surface of the housing.

4. The adapter of claim 1, wherein:

the housing is configured for positioning between a lamp assembly and a surface of a vehicle.

5. The adapter of claim 4, wherein:

the housing is configured for positioning between the lamp assembly and a rear buck-plate of a trailer.

6. The adapter of claim 1, wherein:

the housing is configured for positioning at least partially inside of a recess in a lamp assembly.

7. The adapter of claim 1, wherein:

the logic circuit connects a three-wire wiring harness on a trailer to a two-wire lamp.

8. The adapter of claim 1, wherein:

at least one surface of the housing is configured to conform to at least one surface of a lamp assembly.

9. The adapter of claim 1, wherein:

the lamp connector is configured to conform to one or more surfaces of a lamp.

10. The adapter of claim 1, wherein:

the housing is injection molded.

11. The adapter of claim 10, wherein:

the housing is overmolded.

12. The adapter of claim 1, wherein:

the housing is configured for mounting a lamp assembly onto a first surface of the housing.

* * * * *